US009265696B2

(12) United States Patent
Waeben et al.

(10) Patent No.: US 9,265,696 B2
(45) Date of Patent: Feb. 23, 2016

(54) CLOSURE CAP

(75) Inventors: Reinhard Louis Jozef Waeben, Hasselt (BE); Ralf Dittmer, Straubenhardt (DE); Ronny Prosper Elisabeth Vrijens, Vliermaalroot (BE)

(73) Assignee: Datwyler Pharma Packaging Belgium NV, Alken (BE)

( * ) Notice: Subject to any disclaimer, the term of this patent is extended or adjusted under 35 U.S.C. 154(b) by 0 days.

(21) Appl. No.: 14/112,198

(22) PCT Filed: Apr. 17, 2012

(86) PCT No.: PCT/EP2012/056961
§ 371 (c)(1),
(2), (4) Date: Oct. 16, 2013

(87) PCT Pub. No.: WO2012/143338
PCT Pub. Date: Oct. 26, 2012

(65) Prior Publication Data

US 2014/0042163 A1 Feb. 13, 2014

(30) Foreign Application Priority Data

Apr. 20, 2011 (DE) ..... 10 2011 002 189

(51) Int. Cl.

| | |
|---|---|
| ***A61J 1/00*** | (2006.01) |
| ***A61J 1/06*** | (2006.01) |
| ***A61J 1/14*** | (2006.01) |
| ***A61J 1/18*** | (2006.01) |
| ***B65D 51/00*** | (2006.01) |

(52) U.S. Cl.
CPC *A61J 1/14* (2013.01); *A61J 1/1412* (2013.01); *A61J 1/18* (2013.01); *B65D 51/002* (2013.01); *A61J 1/1406* (2013.01); *A61J 1/1468* (2015.05)

(58) Field of Classification Search
CPC ..... A61J 1/1412; A61J 1/18; A61J 1/14; A61J 1/1406; A61J 2001/1468; B65D 1/002
USPC ..... 215/247, 249; 604/415
See application file for complete search history.

(56) References Cited

U.S. PATENT DOCUMENTS 3,193,128 A * 7/1965 Ravn ..... 215/250
5,405,031 A * 4/1995 Derksen ..... 215/249

(Continued)

FOREIGN PATENT DOCUMENTS

DE 76 24 855 U1 2/1978
DE 100 07 367 A1 8/2001

(Continued)

OTHER PUBLICATIONS

International Search Report of PCT/EP2012/056961, mailed Jul. 23, 2012.

*Primary Examiner* — Fenn Mathew
*Assistant Examiner* — James N Smalley
(74) *Attorney, Agent, or Firm* — Collard & Roe, P.C.

(57) ABSTRACT

The invention relates to a closure cap (1) for a container (2) for receiving a pharmaceutical substance, in particular for an infusion or transfusion bottle, with a flanged cap (4) which is suitable for engagement around a container neck (8) and which has a metal film layer, wherein the flanged cap (4) also has a recess (5) that is covered by a plastic lid (3), the plastic lid (3) is connected to the flanged cap (4) by means of at least one connection element (9) formed on the underside, and the plastic lid (3) is removable at least in part. In order to provide a closure cap for a container for receiving a pharmaceutical substance, which container is safe to handle and meets strict demands regarding its tamper-proofing, it is proposed that the plastic lid (3) is connected to the flanged cap (4) via a plurality of connection elements (9) which are formed on its underside and pass through associated connection openings (11) formed in the flanged cap (4), and that the plastic lid (3), in order to expose the recess (5), has a tear-off tab (12) which extends from a coverage of the recess (5) as far as an edge of the plastic lid (3), wherein no connection between the plastic lid and the flanged cap (4) is formed in the area of the tear-off tab (12).

9 Claims, 3 Drawing Sheets

(56) References Cited

U.S. PATENT DOCUMENTS

| | | | | |
|---|---|---|---|---|
| 5,447,247 | A * | 9/1995 | Derksen | 215/247 |
| 6,868,978 | B2 | 3/2005 | Amschlinger et al. | |
| 2004/0217082 | A1 | 11/2004 | Classens | |
| 2006/0091098 | A1 * | 5/2006 | Thilly et al. | 215/249 |

FOREIGN PATENT DOCUMENTS

| | | | |
|---|---|---|---|
| DE | 10 2010 038 031 | A1 | 4/2012 |
| WO | 01/60699 | A2 | 8/2001 |
| WO | 03/013972 | A1 | 2/2003 |

* cited by examiner

CLOSURE CAP

CROSS REFERENCE TO RELATED APPLICATIONS

This application is the National Stage of PCT/EP2012/056961 filed on Apr. 17, 2012, which claims priority under 35 U.S.C. §119 of German Application No. 10 2011 002 189.2 filed Apr. 20, 2011, the disclosures of which are incorporated by reference. The international application under PCT article 21(2) was not published in English.

BACKGROUND OF THE INVENTION

1. Field of the Invention

The invention relates to a closure cap for a container for receiving a pharmaceutical substance, in particular for an infusion or transfusion bottle, having a flanged cap which is suitable for engaging around a container neck and which has a metal foil layer, the flanged cap also having a cut-out which is overlaid by a plastics cover, the plastics cover being connected in a holding manner to the flanged cap by means of at least one connecting element formed on the underside, and the plastics cover being removable at least in part.

2. the Prior Art

Reference is made initially to DE 76 24 855 U1 as prior art. In the case of the closure cap known from this, when the plastics cover formed in the shape of a loop is lifted off, an end region of the flanged cap, which covers over the closure stopper and is provided by break lines, is torn off, in order to allow the closure stopper that is covered-over by the flanged cap to be pierced by a cannula. Reference is also made to WO 01/60699 A2. The flanged cap of this known closure cap has a cut-out in which on the one hand the closure stopper is exposed, but which on the other hand also forms an encircling edge for connecting elements extending from the plastics cover. In order to be able to pierce into the closure stopper through the cut-out, the plastics cover is to be torn in at the edge and then removed as a whole from the flanged cap. In this way, there also results a separation of the connecting elements from the flanged cap.

SUMMARY OF THE INVENTION

Proceeding from the prior art referred to initially above, it is an object of the invention to provide a closure cap for a container for receiving a pharmaceutical substance which will satisfy the high requirements for authenticity security with reliable operability.

One possible solution to this problem is provided according to a first inventive concept by a closure cap in which the plastics cover is connected to the flanged cap by way a plurality of connecting elements formed on the underside of the cap and engaging through connecting openings formed for this purpose in the flanged cap, separately from the cut-out, and that the plastics cover has a tear-off tab for exposing the cut-out, the tab extending from a location overlying the cut-out as far as an edge of the plastics cover. The invention takes the approach on the one hand of connecting the plastics cover to the flanged cap at a plurality of locations and fixedly, so that when the plastics cover is torn off, this connection can remain preserved. On the other hand, the plastics cover has a tear-off tab for the tearing-off, and when this is removed, the cut-out in the flanged cap is exposed directly for piercing by a cannula. At the same time, it can be reliably determined if a first use has already taken place since the tear-off tab has to be removed for this, but damage is then present at least in the region of a transition from the tear-off tab into the plastics cover, for example at the weakened zone to be described hereinafter.

Further features of the invention are described and illustrated below, also in the description and the drawings, often in their preferred association with the concept already explained and illustrated. They may however also be of importance in association with only one or more individual features which are here described or illustrated in drawings, or independently, or in another overall concept.

Preferably the tear-off tab is not connected to the flanged cap over its entire extent. The tearing-off takes place only relative to the surrounding region of the plastics cover. More preferably, the plastics cover remains connected to the flanged cap even after the tear-off tab has been removed. Only the region of the flanged cap which is in overlap with the tear-off tab is exposed after the tear-off tab has been torn off.

Furhtermore, it is preferred that the plastics cover is connected to the flanged cap by more than two connecting elements, preferably four.

It is also preferred that the connecting elements are distributed at equal angular intervals. In addition, it is preferred that the connection is achieved by hot forming or by ultrasound. The connecting elements are therefore, as it were, riveted to the flanged cap.

The tear-off tab represents in a plan view preferably a circular segment of the plastics cover. The central region is thereby configured according to the cut-out located beneath it, at least up to one half. This one half is preferably formed in the shape of a semi-circular portion. In this regard, the tear-off tab extends out beyond the central point of the plastics cover.

Preferably the plastics cover is not connected to the flanged cap by a connecting element in the region of the tear-off tab. The connection to the flanged cap is instead preferably provided only outside the tear-off tab.

A connecting opening formed in the flanged cap for a connecting element to engage through the flanged cap is preferably matched as regards its opening edge to a cross-sectional outer edge of the connecting element. More preferably, the cross-sectional outer edge is circular in shape and accordingly the peripheral edge of the connecting opening is also formed in the shape of a circle. Also in regard to the diameter or the size of the cut-out, it is preferred that this matches the outer diameter or the outer dimension of the cross-sectional area of the connnecting element in the region of penetration of the flanged cap, or it may also be a little greater. There is accordingly in each case an individual connecting opening, through which there penetrates preferably (only) an individual connecting element, in that a plurality of individual connecting opening are formed, preferably in the flanged cap, that are not in communication with one another.

A hard plastics PP or PE and other plastics materials may serve as the plastics material. The closure stopper may for example consist of a rubber material, but may also consist of a thermoplastic elastomer.

As a whole, the plastics cover is configured as a shell, having a shell edge which is downwardly directed in the state in which it is connected to the flanged cap. The shell edge extends here preferably not as far downwardly as the flanged cap, and is therefore visible in the state in which it has been mounted on the container, in its lower region which also engages around the neck of the bottle, even when the plastics cover is intact.

BRIEF DESCRIPTION OF THE DRAWINGS

The invention is further described below with reference to the accompanying drawings, which however only show an exemplary embodiment. In the figures.

DETAILED DESCRIPTION OF THE DRAWINGS

Figure 1:
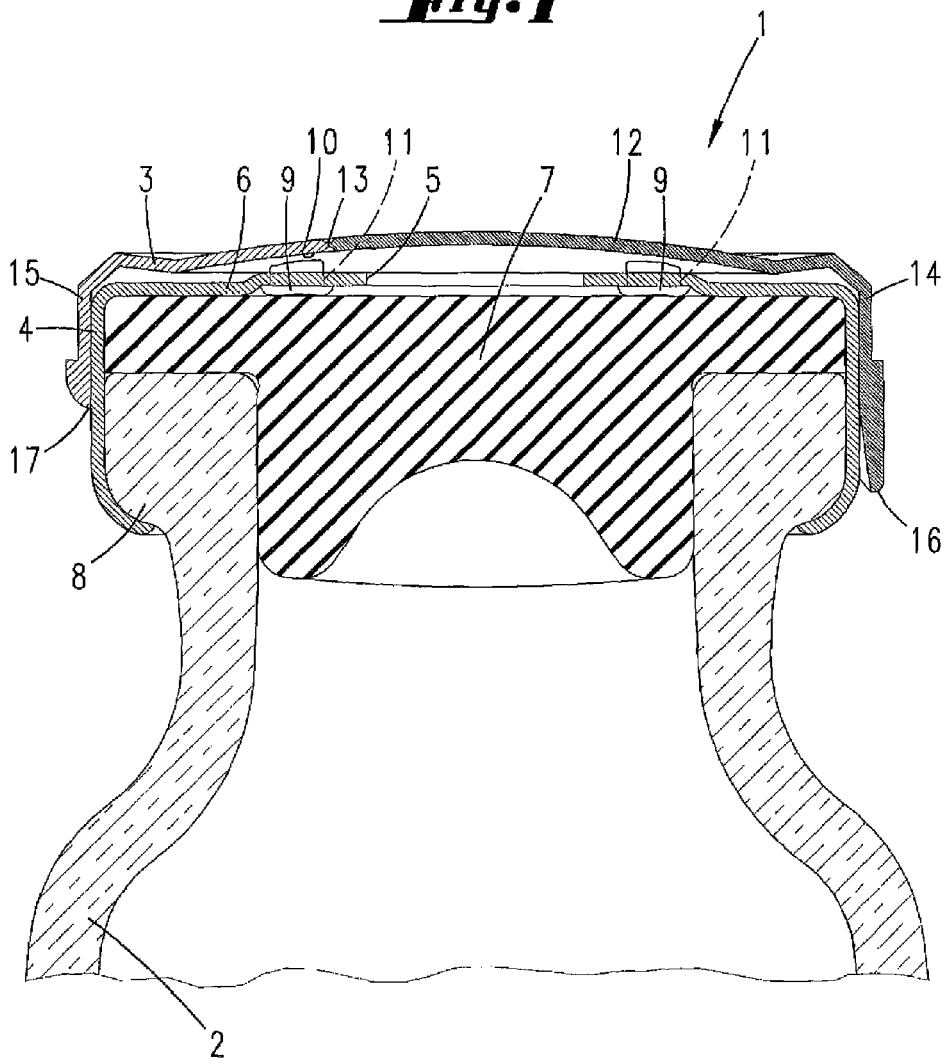
FIG. 1 shows a cross-sectional illustration of a closure cap, fitted onto a container.
Figure 3:
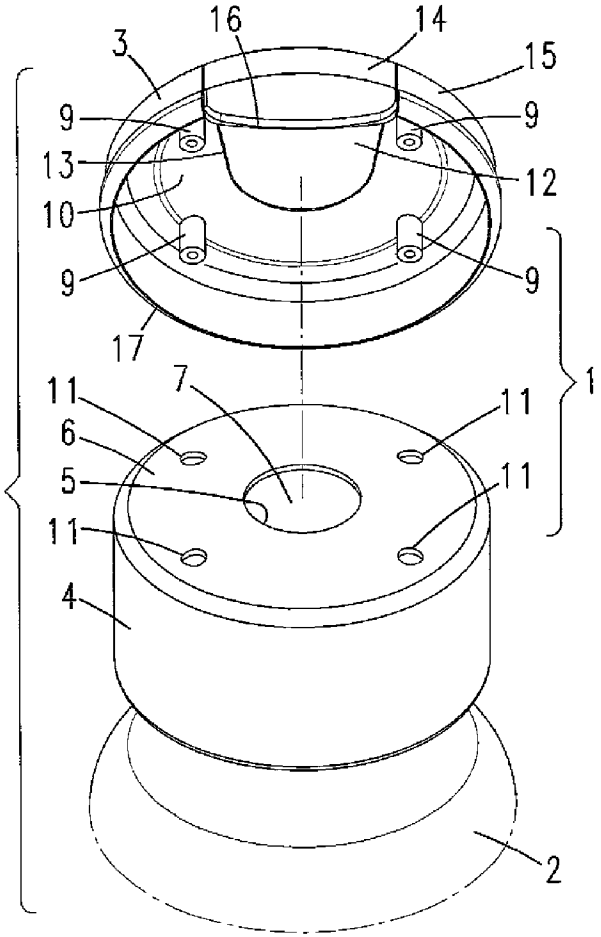
FIG. 3 shows an exploded illustration of the closure cap, in perspective view, before connection to the container.
Figure 2:
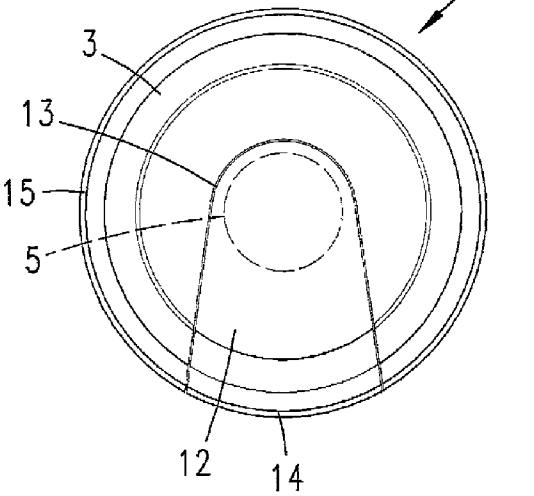
FIG. 2 shows a top view of the closure cap.

Illustrated and described is a closure cap 1 for a container 2. The container 2 may be for example an infusion or transfusion bottle.

The closure cap 1 consists in particular of a plastics cover 3 and a flanged cap 4. The flanged cap 4 consists of a metal part, preferably a metallic foil. Reference is made in this regard for example to the disclosure content of German Patent Application 10 2010 038031, which, in regard to the formation of a flanged cap of this kind, is included in full in the disclosure of the present application, including for the purpose of incorporating features from said application in claims of the present application. A cut-out 5 is formed in the flanged cap 4. The cut-out 5 is preferably, and in the case of the exemplary embodiment, formed centrally in an uppermost disk portion 6 of the flanged cap 4. Under the cut-out 5, there is exposed a closure stopper 7 inserted into a mouth of the container 2. Through the cut-out 5, it is possible to pierce into the closure stopper 7 using a cannula in order to withdraw liquid from the container 2.

A container neck 8 of the container 2 is surrounded by means of the flanged cap 4. The closure 1 is secured to the container 2 in this way.

The plastics cover 3 is connected to the flanged cap 4 by way of connecting elements 9, in the case of the exemplary embodiment and preferably, four connecting elements 9. As can be seen in particular from the illustration according to FIG. 1, the connecting elements 9 are formed as solid or tubular cylindrical parts, which extend freely downwardly from an underside 10 of the plastics cover 3. They engage through openings 11 in the disk portion 6 of the flanged cap 4 and are enlarged by hot forming underneath the disk portion 6 of the flanged cap 4, so that a rivet-like connection to the flanged cap 4 is achieved.

The plastics cover 3 is formed to be shell-like as a whole, having, in the arrangement, a shell edge directed downwardly.

A tear-off tab 12 is formed on the plastics cover 3 and is connected to the remaining part of the plastics cover 3 by a weakened zone 13. The weakened zone 13 can be seen to run in the shape of a U, the cross-bar of the U being configured, in the case of the exemplary embodiment and preferably, in the shape of a semi-circle. The legs of the U in the weakened zone 13 continue at the front into vertical portions 14, which facilitate tearing-off even in the region of the substantially vertically extending circumferential skirt 15 (shell rim) of the cover 3.

A peripheral edge 16 of the tear-off tab 12 runs, in the case of the exemplary embodiment and preferably, at least in part below a lower edge 17 of the plastics cover 3 and specifically, in the case of the exemplary embodiment, of the circumferential skirt 15. It runs moreover preferably at a specific radial spacing from the flanged cap 4, so that it is possible to engage underneath using a finger in order to remove the tear-off tab 12.

It is also possible to deviate from a configuration which leads to the edge, and especially the peripheral edge 16 of the tear-off tab 12, projecting, in particular downwardly, relative to the lower edge 17 of the plastics cover. The tear-off tab 12 can, besides, also be provided to be completely adapted, in contour and/or at the lower edge, to the contour and to the lower edge of the plastics cover 3.

Figure 5:
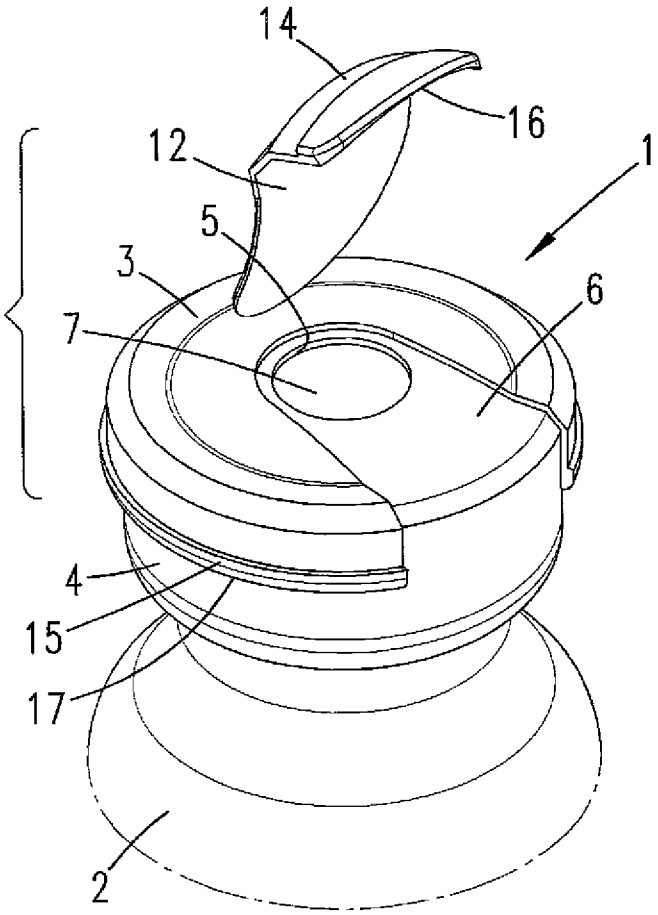
FIG. 5 shows an illustration of the closure cap according to FIG. 4 after removal of the tear-off tab.
Figure 4:
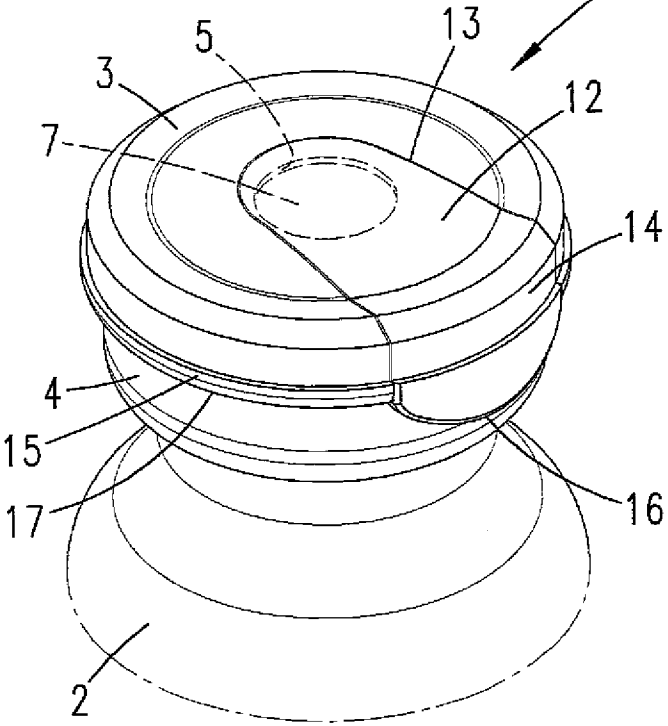
FIG. 4 shows a perspective illustration of the closure cap mounted onto the container.

FIG. 5 shows the state after removal of the tear-off tab 12. The opening 5 is completely exposed so that, as described, it is possible to pierce into the closure stopper 7 using a cannula.

In this state, the flanged cap 4 is otherwise not changed, with the exception that it is exposed in the region of the tear-off tab 12. In particular no part of the flanged cap 4 is torn off or removed or even only bent.

All features disclosed are (in themselves) pertinent to the invention. The disclosure content of the associated/accompanying priority documents (copy of the prior application) is also hereby included in full in the disclosure of the application, including for the purpose of incorporating features of these documents in claims of the present application. The subsidiary claims in their optional subordinated formulation characterize independent inventive refinement of the prior art, in particular to undertake divisional applications based on these claims.

REFERENCE SIGN LIST

1 Closure cap
2 Container
3 Plastics cover
4 Flanged cap
5 Cut-out
6 Disk portion
7 Sealing plug
8 Container neck
9 Connecting element
10 Underside
11 Opening
12 Tear-off tab
13 Weakened zone
14 Vertical portion
15 Circumferential skirt
16 Peripheral edge
17 Lower edge

The invention claimed is:

1. Closure cap for a container for receiving a pharmaceutical substance, having a flanged cap which is suitable for engaging around a container neck and which comprises a metal foil layer, the flanged cap also having a cut-out which is overlaid by a plastics cover, the plastics cover being connected in a holding manner to the flanged cap via a plurality of connecting elements formed on the underside of the cap, and the plastics cover being removable at least in part, wherein the connecting elements engage through respective connecting openings in the flanged cap, wherein the plastics cover has a tear-off tab for exposing the cut-out, the tab extending from a location overlying the cut-out as far as a free edge of the plastics cover without any connection being formed between the plastics cover and the flanged cap in the region of the tear-off tab, wherein the plastics cover remains connected to the flanged cap by way of the connecting elements even after the cut-out has been exposed by removing the tear-off tab, and wherein the connecting elements are enlarged underneath the flanged cap to achieve a rivet-shaped connection to the flanged cap; and wherein the tear-off tab is connected to the remaining part of the plastic cover by a weakened zone, the weakened zone running in an U-shape.

2. Closure cap according to claim 1, wherein more than two connecting elements are provided.

3. Closure cap according to claim 1, wherein the connecting elements are distributed at equal angular intervals.

4. Closure cap according to claim 1, wherein the connection of the plastics cover to the flanged cap is provided by hot forming.

5. Closure cap according to claim 1, wherein the connecting openings are not in communication with each other.

6. Closure cap according to claim 1, wherein a peripheral edge of the tear-off tab runs at least in part below a lower edge of the plastics cover.

7. Closure cap according to claim 6, wherein the cover has a substantially vertically extending circumferential skirt and the peripheral edge runs below a lower edge of the circumferential skirt.

8. Closure cap according to claim 1, wherein a peripheral edge of the tear-off tab runs at a specific radial spacing from the flanged cap to permit engagement underneath using a finger in order to remove the tear-off tab.

9. Closure cap according to claim 1, wherein four connecting elements are provided.

* * * * *